US005630719A

United States Patent [19]

Franklin

[11] Patent Number: 5,630,719

[45] Date of Patent: May 20, 1997

[54] GOLF PUTTING TEACHING AID

[76] Inventor: Terry W. Franklin, 8749 Hummingbird Dr., Frisco, Tex. 75034

[21] Appl. No.: 496,497

[22] Filed: Jun. 29, 1995

[51] Int. Cl.[6] ..... A63B 69/36

[52] U.S. Cl. ..... 434/252; 473/157; 473/159; 473/278

[58] Field of Search ..... 434/252; 473/150, 473/159, 160, 157, 162, 171, 218, 278; 273/34 R, 195 R, 177 R, 178 B

[56] References Cited

U.S. PATENT DOCUMENTS

| | | | |
|---|---|---|---|
| 2,750,195 | 6/1956 | Ching . | |
| 2,894,755 | 7/1959 | Scelzo, Jr. . | |
| 2,992,005 | 7/1961 | Lockhart . | |
| 3,332,688 | 7/1967 | Gevertz . | |
| 3,584,877 | 6/1971 | Florian . | |
| 3,685,833 | 8/1972 | Jack, Jr. . | |
| 3,843,136 | 10/1974 | Buenzle . | |
| 3,899,180 | 8/1975 | Rodman . | |
| 4,017,084 | 4/1977 | Jeffery . | |
| 4,368,888 | 1/1983 | Ren . | |
| 4,544,160 | 10/1985 | Miner . | |
| 4,620,708 | 11/1986 | Meyer et al. . | |
| 4,783,075 | 11/1988 | Simjian | 473/159 |
| 4,805,912 | 2/1989 | Hickman . | |

*Primary Examiner*—Jeffrey A. Smith
*Attorney, Agent, or Firm*—Gregory M. Howison

[57] ABSTRACT

A golf putting teaching aid includes a putting surface that has disposed thereon a cup near one end and a number of patterns disposed along the length thereof. Each of the patterns has parallel lines aligned with the desired putting path, the two parallel lines being separated by a predetermined distance, preferably the width of a typical golf ball. The length of the two parallel lines in each of the patterns increases as the pattern is moved away from the cup. At a predetermined location along each of the two parallel lines in each of the patterns, a ball location area is defined. The golf ball is disposed at this location and then the club first aligned with the ball such that the face thereof is perpendicular to the desired path of travel and then moved back to the most distal end from the cup. Thereafter, it is moved from the most distal end to the most proximal end in an accelerated motion with the ball location being selected such that optimal acceleration of the club head will be present at the contact point to the ball. Perpendicular squaring lines may also be disposed on the putting surface to aid in orienting the club head. Each of the patterns allows the golfer both a visual aid to maintain the face of the club constant along the desired path of travel, and, also, allows the acceleration to be set as a function of the distance from the cup.

8 Claims, 4 Drawing Sheets

GOLF PUTTING TEACHING AID

TECHNICAL FIELD OF THE INVENTION

This invention relates to golf instruction devices, and more particularly to a putting teaching aid.

BACKGROUND OF THE INVENTION

Many golfers, in spite of practice, remain inconsistent in their putting game. A common mistake some of the golfers make in their putting game is to strike the golf ball with the head of the putter while the velocity of the putter head is decelerating rather than accelerating. This deceleration generally results in uneven putting strokes because the amount of initial acceleration and subsequent deceleration of the putting head is difficult to control.

A better method of putting is termed accelerated putting. In accelerated putting the ball is struck while the velocity of the putter head is increasing, i.e., the putter head is accelerating. In this type of putting the golfer is required to learn only a single acceleration motion of the putter which is applicable to any length of putter. This acceleration motion is retained, with repetition, as part of the golfer's muscle memory. The distance the ball travels is then determined by the amount of backswing of the putter head. As the backswing is increased, the pre-contact time of the club head, i.e., the time from the beginning of the swing until the ball is struck, also increases, and therefore the velocity of the club head is greater when it strikes the ball than it would be for a shorter backswing.

A second common mistake of some golfers is to stroke the ball with a putter head that is not traveling along the intended path of the golf ball. That is, the golfer does not swing the putter along the same line as the intended path of the ball, but rather in a path that is oblique to the intended path of the ball. Such a stroke causes the golf ball to deviate from the intended travel path.

A third common mistake of some golfers is to stroke the golf ball with the putter head at an oblique angle to the intended path of the golf ball, rather than perpendicular to the intended path. This oblique angle causes the golf ball to deviate from the intended travel path of the golf ball.

It can be appreciated that a golf putting teaching aid which aids golfers in establishing the proper method of accelerated putting, including the proper path of the putter head and the proper orientation of putter head with respect to the golf ball, is desirable.

U.S. Pat. No. 4,805,912 describes a golf putting teaching aid for use in establishing the proper method of accelerated putting. The teaching aid described therein, however, requires a movable, ruler-like apparatus (called a stroke length ruler) locatable along an edge of the putting surface. The stroke length ruler has marks thereon for aligning the stroke length ruler with squaring lines located on the putting surface and for indicating the proper length of the back swing for each of the squaring lines. The stroke length ruler costs money to fabricate and is inconvenient to use because it must be repositioned whenever the golfer wishes to practice putts from a different distance from the cup.

It is desirable, therefore, that a golf putting teaching aid useful for teaching accelerated putting not require use of a movable stroke length ruler, such as that which is described in U.S. Pat. No. 4,805,912.

SUMMARY OF THE INVENTION

The present invention disclosed and claimed herein comprises a golf putting teaching aid. The teaching aid includes a generally rectangular putting surface having a first end and a second end, with a cup located near the first end. At least one teaching pattern is disposed on the surface of the putting surface a predetermined distance from the cup. The pattern has parallel lines that are disposed along a desired travel path for a golf ball. The parallel lines have a front portion oriented toward the first end of the rectangular surface and a rear portion oriented toward the second end of the putting surface. A central location between the front and rear portions is provided to define the location of the golf ball to be putted. The rear portion is of a predetermined length and the front portion is of a predetermined length for the parallel lines. A squaring line is disposed perpendicular to the parallel lines and on the distal side of the central location for allowing the head of a golf club to be squared to the parallel lines behind the golf ball located in the central location. A second squaring line is also disposed on the distal end of the rear portion perpendicular to the parallel lines for further helping the head of the golf club to be squared perpendicular to the parallel lines. In the putting exercise, the club head is first squared behind the ball and then is moved backward to the rear squaring line. Thereafter, the club head is moved forward from the rear squaring line to or through the proximal end of the pattern. The location of the ball in the central location is designed such that the acceleration of the club head when contacting the ball is optimal.

In another aspect of the present invention, there are provided a plurality of patterns on the putting surface, all substantially similar, with the associated parallel lines oriented in a line to the cup. Each of the patterns has a combined length of the front and rear portions that increases as the pattern increases its distance from the cup.

BRIEF DESCRIPTION OF THE DRAWINGS

For a more complete understanding of the present invention and the advantages thereof, reference is now made to the following description taken in conjunction with the accompanying Drawings in which.

Figure 1:
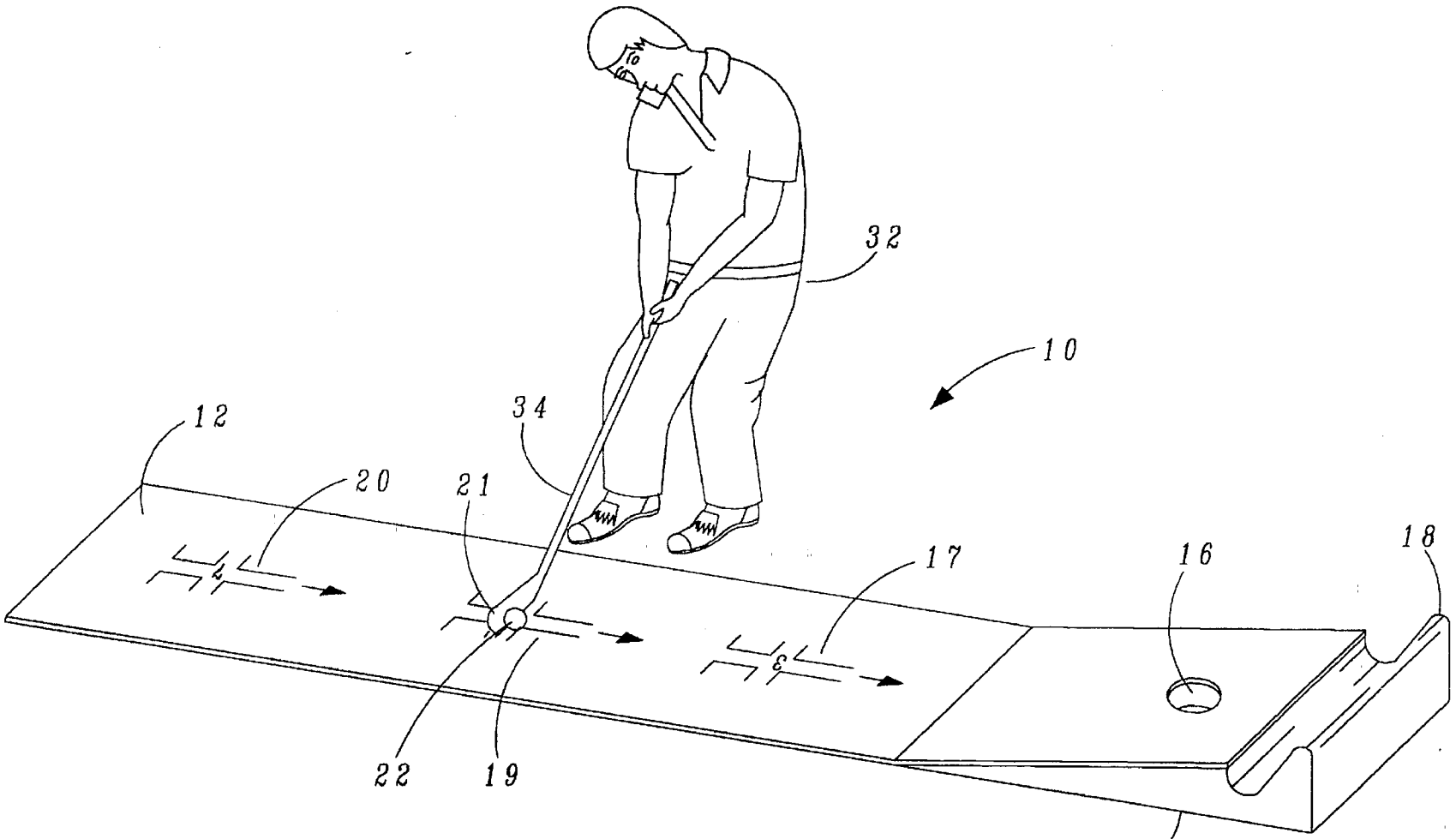
FIG. 1 is a perspective view of a golfer using a golf putting teaching aid according to the present invention.

It will be appreciated that for purposes of instruction, the accompanying drawings have not necessarily been drawn to scale; and that for clarity and where deemed appropriate, reference numerals have been repeated in the FIGURES to indicate corresponding features.

DETAILED DESCRIPTION OF THE INVENTION

Referring now to FIG. 1, there is illustrated a golf putting teaching aid, shown generally as element 10, that includes a rectangular putting surface 12. The putting surface 12 in the preferred embodiment is portable and made of green artificial turf, and one end of the putting surface is glued to a foam backing 14. The foam backing 14 is sufficiently thick to include a cup 16 formed therein, and one end of the foam backing 14 is slanted to provide a gentle rise in the putting surface 12 to the cup 16. Attached to the short end of the putting surface 12 near the cup 16 is a back stop 18 which stops golf balls which miss the cup 16.

On the surface of the teaching aid are disposed three patterns, a three-foot pattern 17, a five-foot pattern 19 and a seven-foot pattern 20. Each of these is painted onto the surface. The details of each of these will be described hereinbelow. A ball 22 is illustrated disposed on the five-foot pattern 19 at the center thereof. A golfer 32 is illustrated holding a club comprised of a shaft 34 and a club head 21. The club head 21 is illustrated as being next to the ball 22.

In operation, the golfer 32 utilizes the pattern 19, or, alternately, the patterns 17 or 20, to allow for both head positioning, i.e., keeping it square to the cup, and to determine the acceleration of the club head 21. This will be described in more detail hereinbelow.

Figure 2A:
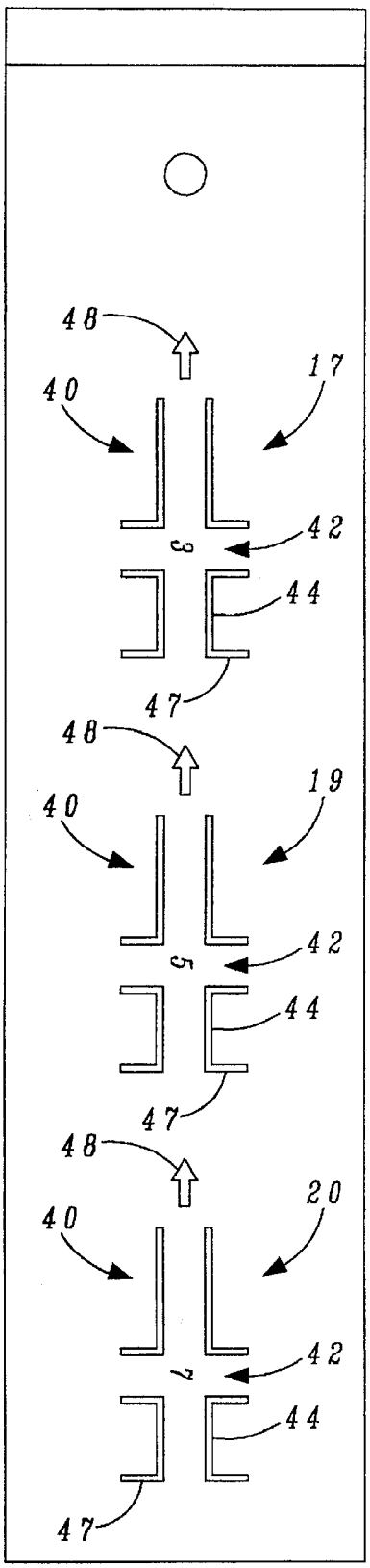
FIG. 2*a* illustrates a top view of the golf putting teaching aid.

Referring now to FIG. 2*a*, there is illustrated a top view of the putting surface 12. Each of the patterns 17, 19 and 20 are comprised of two portions, a front portion 40 disposed forward of a central portion 42, and a rear portion 44 extending rearward of the central portion 42. The front portion 40 of the three-foot pattern 17 has a length of 9 inches and the rear portion 44 of the three-foot pattern 17 has a length of 4 inches. The distance between the front portion 40 and the rear portion 44 for each of the patterns 17, 19 and 20 is approximately 1¾ inches. The length of the front portion 40 of the pattern 19 is approximately 9½ inches and the length of the rear portion 44 of the pattern 19 is approximately 5 inches. The length of the from portion 40 of the pattern 20 is approximately 10 inches and the length of the rear portion 44 of the pattern 20 is approximately 6 inches.

Figure 2B:
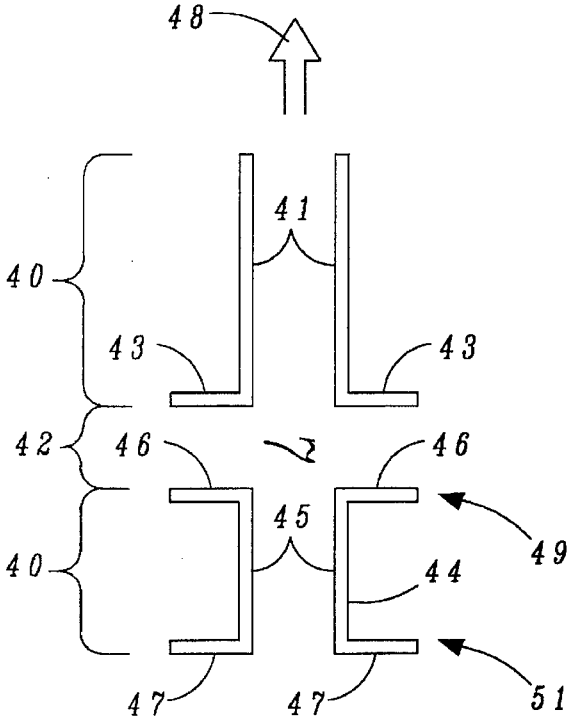
FIG. 2*b* illustrates a teaching pattern that is disposed on the surface of the golf putting teaching aid.

Referring now to FIG. 2*b*, the teaching pattern 20 is illustrated in greater detail. The front portion 40 is comprised of two parallel lines 41 that are separated by a distance approximately the same as the width of a golf ball. Each of the lines 41 is terminated adjacent the central portion 42 by a short perpendicular line segment 43.

The rear portion 44 is similarly comprised of two parallel lines 45 that are separated by a distance approximately the same as the width of a golf ball. The parallel lines 45 are in substantial alignment with the lines 41o Each of the lines 45 is terminated adjacent the central portion 42 by a short perpendicular proximal squaring line segment 46, and is terminated at the end distal from the cup 16 by a short perpendicular distal squaring line segment 47.

The line segments 46 together comprise a squaring line 49 that is proximal to the cup 16 and the line segments 47 together comprise a squaring line 51. The length of the lines 45, which is substantially the same as the distance between squaring lines 49 and 51 indicate to the golfer 32 the proper amount of back stroke to use. The number "7" is disposed in the central portion 42 to indicate to the golfer 32 the distance from the central portion 42 to the cup 16. The line segments 43 aid in defining the central portion 42 and thereby help indicate where the golf ball is to be placed. A directional arrow 48 is disposed near the end of the lines 41 that is most proximal to the cup 16. The arrow 48 is intended to suggest to the golfer 32 that the forward stroke should not be abruptly finished, but instead, should naturally continue up to or through the arrow.

Each of the patterns 17 and 19 are similar to pattern 20, but each has a different number disposed in the central portion 42 and the parallel lines 45 are of shorter length.

The central portion 42 of the three-foot pattern 17 is disposed three feet from the front of the cup 16, the central portion 42 of the five-foot pattern 19 is disposed five feet from the front edge of the cup 16, and the central portion 42 of the seven-foot pattern 20 is disposed seven feet from the front of the cup 16. This allows the golfer 32 the opportunity to practice putting from three different distances. As will be described hereinbelow, each distance requires the golfer 32 to use a different acceleration for the putting motion. Additionally, the use of the patterns and the layout thereof allows the golfer to visualize the orientation of the head 21 of the putter while maintaining eye contact with the ball and the putter head 21, in addition to having a visual relationship of the pattern with the cup 16. It is the integration of all of these aspects that provides some of the important aspects of the present invention.

Figure 3A:
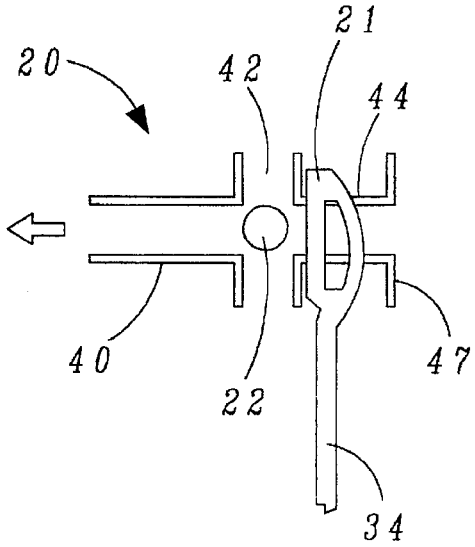
FIGS. 3*a*–3*c* illustrate diagrammatic views of the teaching aid in use.
Figure 3B:
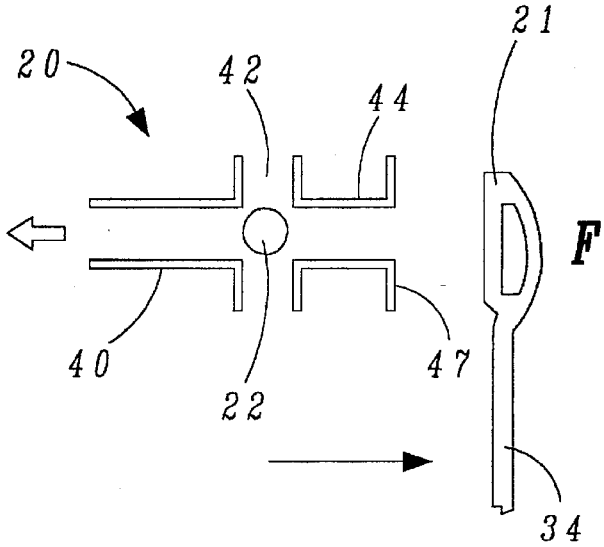
Figure 3C:
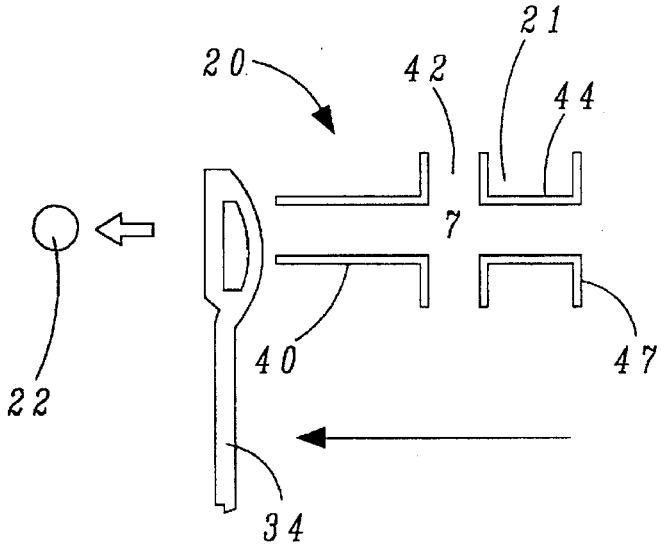

Referring now to FIGS. 3*a*–3*c*, there is illustrated a diagrammatic view of the sequence of steps involved in the putting motion provided by the teaching aid of the present invention. For illustrative purposes, the pattern 20 for the seven-foot distance is illustrated. With specific reference to FIG. 3*a*, the ball 22 is disposed in the central portion 42, between the parallel lines 41 of the front portion 40 and parallel lines 45 of rear portion 44. The club head 21 is then oriented such that it is perpendicular to the parallel lines 45 using the squaring line 49 for alignment thereof, the club head 21 being in close proximity to the ball 22. In golf terminology, this is the point at which the ball is addressed. From this position, the club head 21 is moved back to the line segments 47 while still being aligned perpendicular to the parallel lines 45. Since the lines on the rear portion 44 are parallel, the club head 21 may easily be moved back with the face of the club head 21 remaining perpendicular to the desired path, which, of course, is directly to the cup. Once club head 21 reaches the line segments 47, which are perpendicular to the parallel lines 45, the face of the club head 21 can be maintained in a perpendicular orientation. This is illustrated in FIG. 3*b*.

In FIG. 3*c*, it can be seen that the club head 21 is then moved from the line segments 47 at the most distal end of the portion 44 through the central portion 42 with the face of the club head 21 contacting the ball 22 and then following through up to or through the arrow 48. This allows the club head 21 to be accelerated through a predetermined distance and, while being accelerated, the golfer is taught to maintain the face of the club head 21 in a perpendicular orientation with respect to the path. A predetermined length on the rear portion 44 helps to establish the proper acceleration of the club head 21. The length of the front portion 40 also helps to determine the acceleration. This is due to the fact that the golfer 32 typically visualizes the movement of the club head from the line segments 47 to the end of portion 40, which is nearest the cup 16. This represents an acceleration from one end to the other. By placing the central portion 42 at the proper location, the acceleration at the central portion 42 can be set. As noted above, each distance from the putting location to the front edge of the cup 16 requires a different acceleration of the club head 21.

Figure 4A:
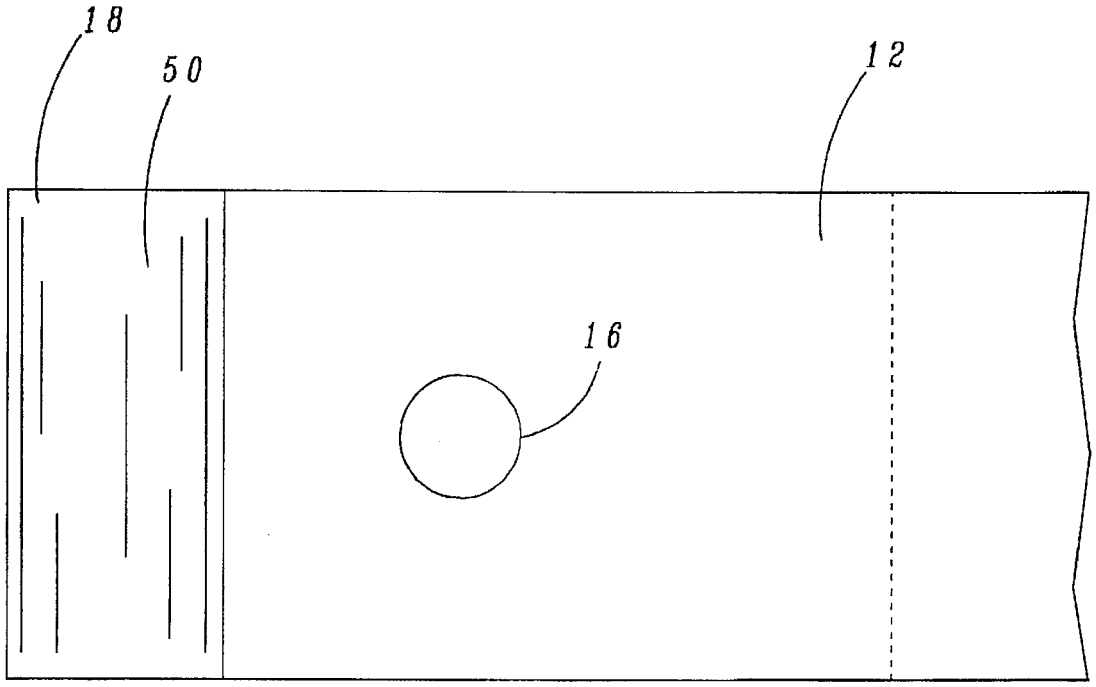
FIGS. 4*a* and 4*b* illustrate top and side views of the ball receptacle.
Figure 4B:
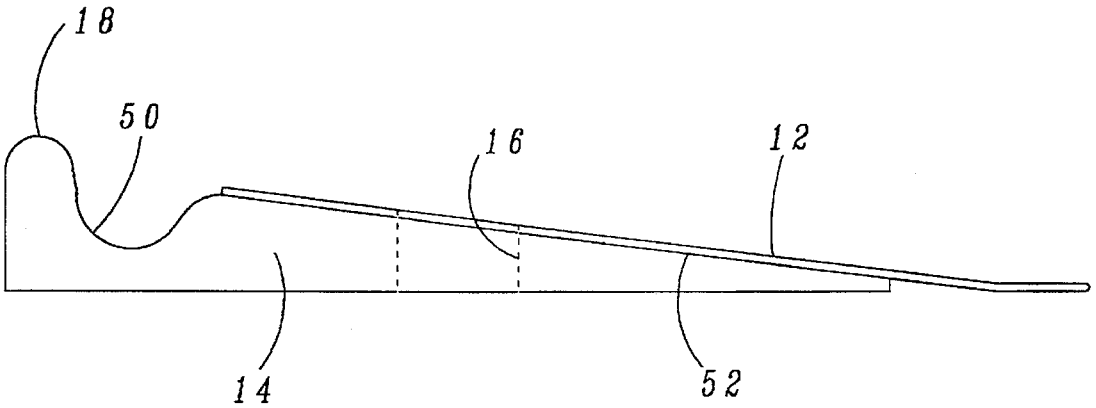

Referring now to FIG. 4*a* and FIG. 4*b*, there are illustrated top and side views, respectively, of the end portion of the putting surface 12 about the cup 16. The back stop 18 is formed as part of the foam backing 14 and is separated from the cup 16 by a trough 50, which trough 50 is operable to receive balls that are not hit into the cup 16. It can also be seen that there is a ramp 52 disposed between the back stop 18 and the position on the opposite side of the cup 16. This ramp inclines at a slight angle. The ramp begins at a point approximately 23 inches from the back stop 18, with the cup 16 disposed substantially in the center thereof. The ramp rises to a height of 1.5 inches just prior to reaching the trough 50. The foam backing 14 at the bottom of the trough 50 is approximately three-quarters of an inch thick. The back stop 18 is approximately 3⅛ inches tall. The width of the putting surface 12 is approximately 12 inches. The cup 16 is approximately 4 inches in diameter.

The putting surface 12 is preferably constructed of polypropylene material. Ordinary commercially available paints generally do not adhere well to such material, thus causing some difficulty in disposing the patterns 17, 19 and 20 on the putting surface 12. This problem has been solved by mixing a vinyl acrylic-based paint, such as Pintexs Chemicals Stripe Traffic Paint with a clear drying vinyl acrylic adhesive, such as type 50-3022 by *United Resin Products*, Inc. in a ratio of three parts paint to two parts adhesive.

In summary, there has been provided a golf putting teaching aid that has a plurality of patterns disposed on a putting surface. Near one end of the putting surface is disposed a putting cup. The patterns are teaching aids and are comprised of two sets of parallel lines of predetermined lengths. The length of each pattern varies and is a function of the distance of the pattern from the cup. At a predetermined position along the parallel lines, which are in line with the path to the cup, there is provided a ball locating position. The ball locating position is disposed at a point such that, when the club is moved from the end most distal to the cup to the end most proximal to the cup, the golf club will have the appropriate acceleration at the ball when the face thereof contacts the ball. By increasing the length of the pattern as the distance increases from the cup, more acceleration is imparted to the head of the golf club, such that the club face impacts the ball with a higher level of kinetic energy which is then transferred to the ball. Line segments that are perpendicular to the parallel lines comprise squaring lines. By providing the parallel lines and the squaring lines, the golf club head can visually be aligned with the face thereof perpendicular to the direction of travel of the ball, while allowing the face to be kept at a predetermined perpendicular path to the path of desired travel for the ball. This helps keep the club face from "turning."

Although the preferred embodiment has been described in detail, it should be understood that various changes, substitutions and alterations can be made therein without departing from the spirit and scope of the invention as defined by the appended claims. The parallel lines of the pattern, for example, could be replaced by a single line down the middle of the putting surface, which single line preferably would be a relatively wide line, in combination with squaring lines disposed perpendicular to the single line.

What is claimed is:

1. A golf putting teaching aid, comprising:

a generally rectangular putting surface having a first end and second end;

at least one teaching pattern disposed on said putting surface at a predetermined distance from said first end, said pattern having:

two parallel lines disposed along a desired travel path for a golf ball and having a proximal end oriented toward said first end of said putting surface and a distal end oriented toward said second end of said putting surface, a central location disposed a predetermined distance between said proximal and distal ends for locating a golf ball to be putted, and for defining a rear portion of said parallel lines having a predetermined length and a front portion of said parallel lines having a predetermined length, a first squaring line disposed perpendicular to said parallel lines and on the distal side of said central location for allowing the head of a golf club to be squared to said parallel lines behind the golf ball when located in said central location, a second squaring line disposed perpendicular to said distal end of said parallel lines for aligning the head of the golf club to be squared to the distal end of said parallel lines, and said combined rear portion length and front portion length of said parallel lines approximating the desired length of the accelerated stroke for a putting exercise wherein the head of the club is first squared behind the golf ball in said central location by aligning it with said first squaring line and then moved backward to said second squaring line and then moved in an accelerated motion from said second squaring line to a position proximate to said proximal end of said parallel lines, and said central location disposed such that the acceleration of the club head when striking the golf ball in said central location is substantially optimal when the club has moved from said second squared line at said distal end of said parallel lines to said proximal end of said parallel lines; and said rectangular putting surface further includes a cup disposed in line with said parallel lines at said first end a predetermined distance from said central location in said at least one teaching pattern.

2. The golf putting teaching aid of claim 1, and further including a stop and a trough member for containing a golf ball when the golf ball passes said cup, said cup disposed between said at least one teaching pattern and said trough.

3. The golf putting teaching aid of claim 1, wherein said pattern is painted onto the surface of said putting surface.

4. A golf putting teaching aid, comprising:

a generally rectangular putting surface having a first end and second end:

at least one teaching pattern disposed on said putting surface at a predetermined distance from said first end, said pattern having:

two parallel lines disposed along a desired travel path for a golf ball and having a proximal end oriented toward said first end of said putting surface and a distal end oriented toward said second end of said putting surface, a central location disposed a predetermined distance between said proximal and distal ends for locating a golf ball to be putted, and for defining a rear portion of said parallel lines having a predetermined length and a front portion of said parallel lines having a predetermined length, a first squaring line disposed perpendicular to said parallel lines and on the distal side of said central location for allowing the head of a golf club to be squared to said parallel lines behind the golf ball when located in said central location.

a second squaring line disposed perpendicular to said distal end of said parallel lines for aligning the head of the golf club to be squared to the distal end of said parallel lines, and said combined rear portion length and front portion length of said parallel lines approximating the desired length of the accelerated stroke for a putting exercise wherein the head of the club is first squared behind the golf ball in said central location by aligning it with said first squaring line and then moved backward to said second squaring line and then moved in an accelerated motion from said second squaring line to a position proximate to said proximal end of said parallel lines, and said central location disposed such that the acceleration of the club head when striking the golf ball in said central location is substantially optimal when the club has moved from said second squared line at said distal end of said parallel lines to said proximal end of said parallel lines;

a plurality of teaching patterns, each having two parallel lines associated therewith and said parallel lines of each of said teaching patterns disposed along a common line to said first end and each having different lengths of said associated front portions and rear portions wherein the combined lengths of said front portions and rear portions are lengthened as said pattern increases its difference from said first end.

5. A golf putting teaching aid, comprising:

a generally rectangular putting surface having a first end and a second end;

a cup disposed proximate to said first end for receiving a golf ball;

at least one teaching pattern disposed on and integral with said putting surface at a predetermined distance from said cup, said pattern having:

a ball location area for indicating the location of the golf ball on said putting surface;

a club squaring indicator disposed behind said ball location area for providing a visual indication to the user of a perpendicular orientation of a golf club head to a golf ball when disposed in said ball location area when addressing the golf ball with the golf club head;

a stroke initiator indicator disposed rearward of the ball location area and on said putting surface for indicating the distance that the club head should be moved away from said ball location area, the distance of said stroke initiator indicator from said ball location area being a function of the distance of said ball location area from said cup;

a stroke direction indicator disposed on the surface of said putting surface and proximate to said ball location area and said club squaring indicator, such that said stroke direction indicator can be viewed while viewing the golf ball when located in said ball location area during use of the teaching aid, said indicator extending from a position proximate said club squaring indicator to a position forward of said ball location area toward said cup and in the path of desired travel of the golf ball;

and extending along the desired path between said stroke initiator indicator, through said ball location area to a position forward of said ball location area toward said cup; and said stroke direction indicator is comprised of lines that extend from said stroke initiator indicator to said ball location area, and two parallel lines that extend from said ball location area to forward of said ball location area toward said cup a predetermined distance from said ball location area, said predetermined distance being a function of the distance of said ball location area from said cup.

6. The golf putting teaching aid of claim 5, and further comprising a second club squaring indicator disposed proximate to said stroke initiator indicator for providing guidance to the user for squaring the golf club head when disposed proximate to said stroke initiator indicator, such that the golf club head is maintained perpendicular to the desired path of travel of the ball.

7. The golf teaching aid of claim 5, wherein said-two parallel lines are separated by a distance approximately the diameter of a conventional golf ball.

8. The golf putting teaching aid of claim 5, and further comprising a plurality of said teaching patterns disposed at different distances from said cup.

* * * * *